US011723470B1

(12) United States Patent
Farley et al.

(10) Patent No.: US 11,723,470 B1
(45) Date of Patent: Aug. 15, 2023

(54) HEAD SUPPORT APPARATUS AND METHOD

(71) Applicants: Robert C. Farley, Gulf Breeze, FL (US); Clif Parker, Suwanee, GA (US)

(72) Inventors: Robert C. Farley, Gulf Breeze, FL (US); Clif Parker, Suwanee, GA (US)

( * ) Notice: Subject to any disclaimer, the term of this patent is extended or adjusted under 35 U.S.C. 154(b) by 173 days.

(21) Appl. No.: 17/232,905

(22) Filed: Apr. 16, 2021

Related U.S. Application Data

(60) Provisional application No. 63/011,400, filed on Apr. 17, 2020.

(51) Int. Cl.
*A47C 7/38* (2006.01)

(52) U.S. Cl.
CPC ..... *A47C 7/383* (2013.01)

(58) Field of Classification Search
CPC ..... A47C 7/38; A47C 7/383
USPC ..... 248/118
See application file for complete search history.

(56) References Cited

U.S. PATENT DOCUMENTS

| | | | | |
|---|---|---|---|---|
| D582,045 | S * | 12/2008 | James | A47C 7/383 D6/601 |
| 10,076,190 | B2 * | 9/2018 | Atkinson | A47C 7/383 |
| 10,702,082 | B2 * | 7/2020 | Wong | A47C 7/383 |
| D893,917 | S * | 8/2020 | Bellot | D6/601 |
| 2020/0237123 | A1 * | 7/2020 | Yu | A61F 5/3707 |
| 2021/0030174 | A1 * | 2/2021 | Romo | A47C 16/00 |
| 2021/0127839 | A1 * | 5/2021 | Recchia | A47G 9/1081 |
| 2021/0127867 | A1 * | 5/2021 | Lee | A47C 7/383 |
| 2021/0352981 | A1 * | 11/2021 | Pagan | A47G 9/1081 |

* cited by examiner

*Primary Examiner* — Muhammad Ijaz
(74) *Attorney, Agent, or Firm* — J. Nevin Shaffer, Jr.

(57) ABSTRACT

A head support apparatus and method with a wrap with a top, a bottom, a front, a back, a length, an inside and an outside and a first end and a second end. A connector on the first end and the second end where the connector on the first end is connectable with the connector on the second end. Cushion material, with a width, on the inside of the wrap where the cushion material width is greater along the length and front to back than at the first end and second end of the wrap and an indentation in the front of the wrap and in the cushion material such that a user's jaw is supported underneath the jaw and a user's head is laterally supported on two sides when said wrap is placed around a user's neck.

18 Claims, 5 Drawing Sheets

HEAD SUPPORT APPARATUS AND METHOD

CROSS REFERENCE TO RELATED APPLICATION

This application claims the benefit of previously filed U.S. provisional patent application No. 63/011,400 for a "Head Support Apparatus and Method". The Applicant hereby claims the benefit of this provisional application under 35 U.S.C. § 119. The entire content of this provisional application is incorporated herein by this reference.

FIELD OF THE DISCLOSURE

The present invention pertains to a head support with a wrap with a top, a bottom, a front, a back, a length, an inside and an outside and a first end and a second end. A connector on the first end and the second end where the connector on the first end is connectable with the connector on the second end. Cushion material, with a width, on the inside of the wrap where the cushion material width is greater along the length and front to back than at the first end and second end of the wrap and an indentation in the front of the wrap and in the cushion material such that a user's jaw is supported underneath the jaw and a user's head is laterally supported on two sides when said wrap is placed around a user's neck.

BACKGROUND OF THE INVENTION

The problem with trying to sleep when seated, when flying for example only and not by limitation, is that sleep is virtually impossible. While awake, a person can consciously keep their head upright and centered but once asleep, a person's head will fall to one side and forward without exception. The prior art solution, consists of a U-shaped pillow with the opening in the front that is supposed to allow a person to sleep upright. Unfortunately, these prior art solutions do not provide sufficient support on either side of the head nor do they support the head in an upright manner or prevent it from falling forward. As a result, user's of the prior art "horse collar" pillows find them only partially comforting and not entirely satisfactory.

Thus, there is a need in the art for a device that addresses the aforementioned problems in a manner that is robust and flexible so as to accommodate a full spectrum of user head shapes and dimensions and still enable comfortable upright support both laterally to either side and forward.

It therefore is an object of this invention to provide an improved head support apparatus and method that is easy to use and economical to create and operate and that supports a user's head laterally to both sides and prevents forward movement as well.

SUMMARY

Accordingly, a head support apparatus and method according to a preferred embodiment consists of a wrap with a top, a bottom, a front, a back, a length, an inside and an outside and a first end and a second end. A connector on the first end and the second end where the connector on the first end is connectable with the connector on the second end. Cushion material, with a width, on the inside of the wrap where the cushion material width is greater along the length and front to back than at the first end and second end of the wrap and an indentation in the front of the wrap and in the cushion material such that a user's jaw is supported underneath the jaw and a user's head is laterally supported on two sides when said wrap is placed around a user's neck.

All terms used herein are given their common meanings such that "wrap" describes a material that covers another object, such as a fabric around a sofa cushion such that the wrap may be removable for cleaning, for example only and not by limitation. The wrap thus conforms its dimensions and shape to fit the cushion on the inside just as the present wrap does with the "cushion material" described herein.

"Cushion material" describes a material that provides yielding support to an object, again, such as a sofa cushion, for example. The shape of the cushion material is consistent with the shape of the wrap such that a smooth outer form is provides.

"Indentation" describes a variation in form such as a depression or valley as in the present invention into which a user's jaw is placed.

In one aspect, the invention further includes a cut out on both sides of the indentation in the cushion material and the wrap where the cut outs are configured to receive and retain a user's shoulders. In another aspect, the cut out on both sides of the indentation are inverted U-shapes.

In one aspect, the indentation is in the top of the front of the cushion material and wrap and the cut out on both sides of the indentation are in the bottom of the front of the cushion material and wrap.

In one aspect, the indentation is V-shaped. In further aspects, the invention includes a V-shaped indentation and inverted U-shaped cutouts, one on each side of the V-shaped indentation.

In another aspect, the invention further includes a personal protection mask removably connected to said wrap.

In one aspect, the wrap is washable.

In one aspect, the connector on one end is hook material and the connector on the other end is loop material.

According to another embodiment, a head support apparatus includes a wrap with a top, a bottom, a front, a back, a length, an inside and an outside and a first end and a second end. A connector on the first end and the second end where the connector on the first end is connectable with the connector on the second end. Cushion material, with a width, on the inside of the wrap where the cushion material width is greater along the length and front to back than at the first end and second end, An indentation in the front of the wrap and in the cushion material such that a user's jaw is supported underneath the jaw and a user's head is laterally supported on two sides when the wrap is placed around a user's neck. And a cut out on both sides of the indentation in the cushion material and the wrap where the cut outs are configured to receive and retain a user's shoulders.

In one aspect of this embodiment, the indentation is in the top of the front of the wrap and the cushion material and the cut out on both sides of the indentation are in the bottom of the wrap and the cushion material.

In one aspect, the indentation is V-shaped.

In another aspect, the cut out on both sides of the indentation are inverted U-shapes.

In a further aspect, the indentation is in the top of the front of the cushion material and wrap and the cut out on both sides of the indentation are in the bottom of the front of the cushion material and wrap.

In another aspect, the invention further includes a V-shaped indentation and inverted U-shaped cutouts, one on each side of the V-shaped indentation.

In one aspect, the invention further includes a personal protection mask removably connected to the wrap.

In another aspect, the wrap is washable and the connector on one end is hook material and the connector on the other end is loop material.

According to another embodiment, a method for supporting a head consists of:

a. providing a wrap with a top, a bottom, a front, a back, a length, an inside and an outside and a first end and a second end; a connector on the first end and the second end where the connector on the first end is connectable with the connector on the second end; cushion material, with a width, in the wrap at the front, back and length where the cushion material width is greater along the length and front to back than at the ends; and an indentation in the front of the wrap and in the cushion material such that a user's jaw is supported underneath the jaw and a user's head is laterally supported on two sides when said wrap is placed around a user's neck; and b. placing the wrap around a user's neck with the user's jaw in the indentation.

In one aspect, the method further includes a cut out on both sides of the indentation in the cushion material and the wrap where the cut outs are configured to receive and retain a user's shoulders.

In another aspect, the indentation is V-shaped and the cutouts are inverted U-shapes.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF EMBODIMENTS

Figure 1:
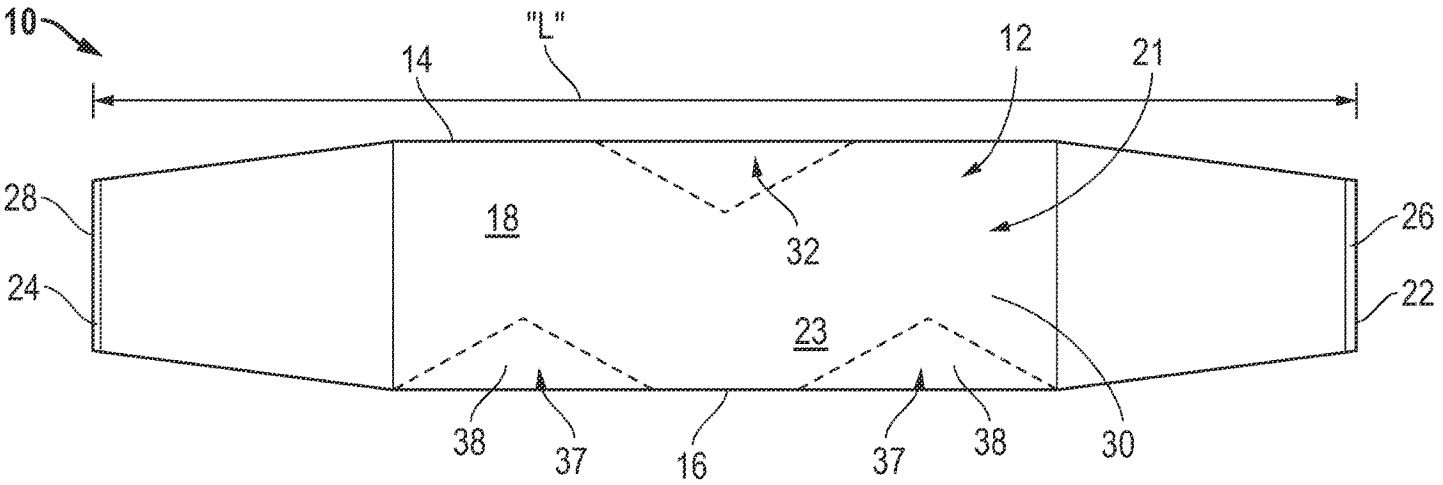
FIG. 1 is a top schematic view of the front of the head support apparatus laid out flat with the ends disconnected.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described process may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated. For example, further insubstantial approximations of the process and/or algorithms are also considered within the scope of the processes described herein.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

Figure 2:
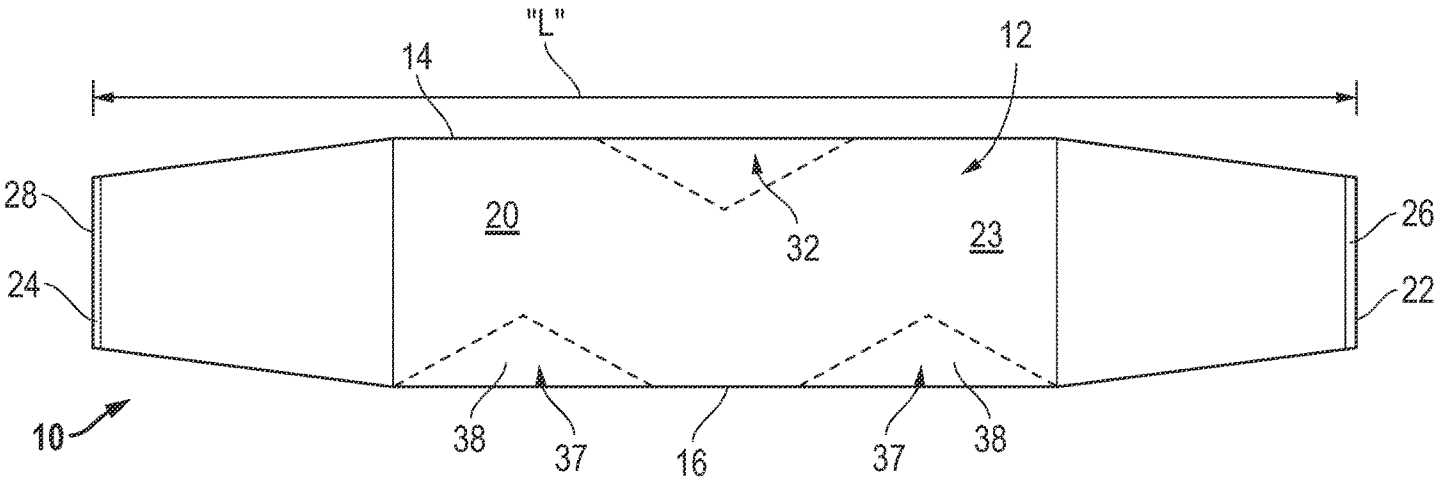
FIG. 2 is a top schematic view of the back of the invention of FIG. 1.

One embodiment of the present invention is illustrated by way of example in FIGS. 1-5. Referring to FIGS. 1 and 2, head support apparatus and method 10 consists of a wrap 12 with a top 14, a bottom 16, a front 18, a back 20, an inside 21 and an outside 23, a length "L", a first end. 22 and a second end 24. A connector 26 on the first end 22 and another connector 28 on the second end is provided where the connector 26 on the first end 22 is connectable with the connector 28 on the second end 24 such that the two ends are joined together when and as desired. Cushion material 30, with a width "W", is provided on the inside 21 of the wrap 12 filling the wrap from the front 18 to the back 20 and along the length "L". The cushion material 30 has a width "W" that greater along the length "L" and from front 18 to back 20 than at the ends 22 and 24. Thus, the head support 10 can be seen to taper in dimension at the two ends as illustrated.

Again, it should be understood that wrap 12 is a cover, preferably removable for cleaning, over cushion material 30. Cushion material 30 may be any material such as foam for example only and not limitation now known or hereafter developed. Certainly, wrap 12 may in fact just be the outer contacting surface of cushion material 30 and not be configured for removal.

Still referring to FIGS. 1 and 2, an indentation 31 is provided and, preferably is a V-shape 32 as shown. The indentation is located in the front 18 of the wrap 12 and from front 18 to the back 20 at the top 14 of the wrap and in the cushion material 30 such that a user's jaw 34 (not shown; see FIG. 4) is supported laterally on two sides and underneath when the wrap 12 is placed around a user's neck 36 and the user's jaw 34 is placed in the V-shape 32. In another aspect, the V-shape 30, indentation 31, is only on the top 14 of the wrap 12, cushion material 30, so that the bottom 16 does not include the V-shape 30.

Figure 4:
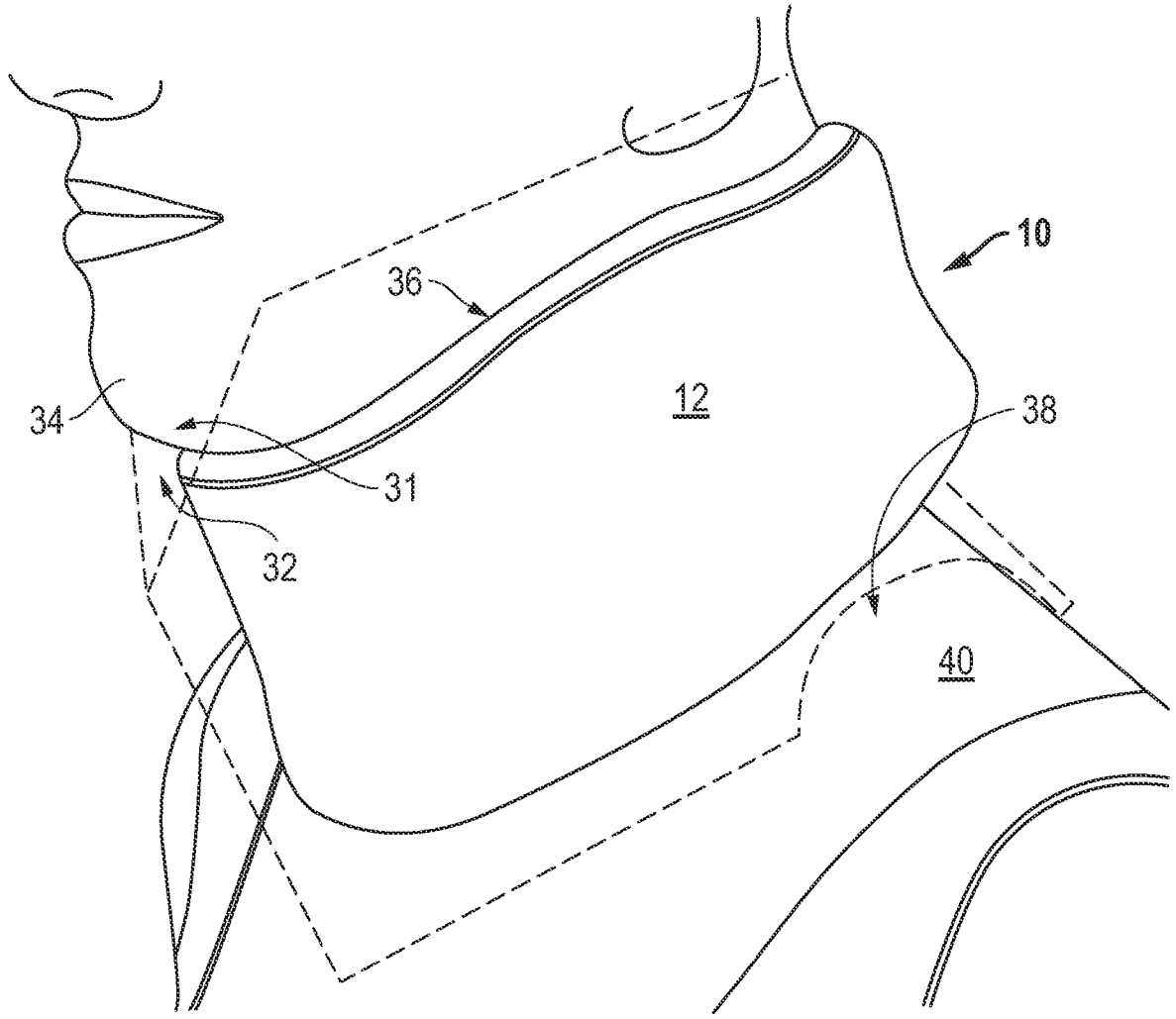
FIG. 4 is a perspective view of the invention of FIG. 1 connected around a user's neck.

Further, in one embodiment, cut outs 37 are provided on both sides of the V-shape 32 in the wrap 12 and the cushion material 30 where preferably cutouts 37 are inverted U-shapes 38 that are configured to receive and retain a user's shoulders 40 (See FIG. 4). Here again, in one embodiment, the inverted U-shapes 38 are only on either the top 14 or the bottom 16 but, of course, they could be on both the top 14 and bottom 16. That is to say, it may be that the head support 10 with the indentation 31 may have cut outs 37 at both the top 14 and bottom 16 such that a user can attach the head support 10 where the jaw 34 is not placed in the indentation 31 while at the same time in both cases the user's shoulders 40 are placed in the cutouts 37.

Still further, in one embodiment, the connector, 26 or 8, on one end, 22 or 24, is hook material and the connector on the other end is loop material commonly sold under the brand name VELCRO.

Figure 3:
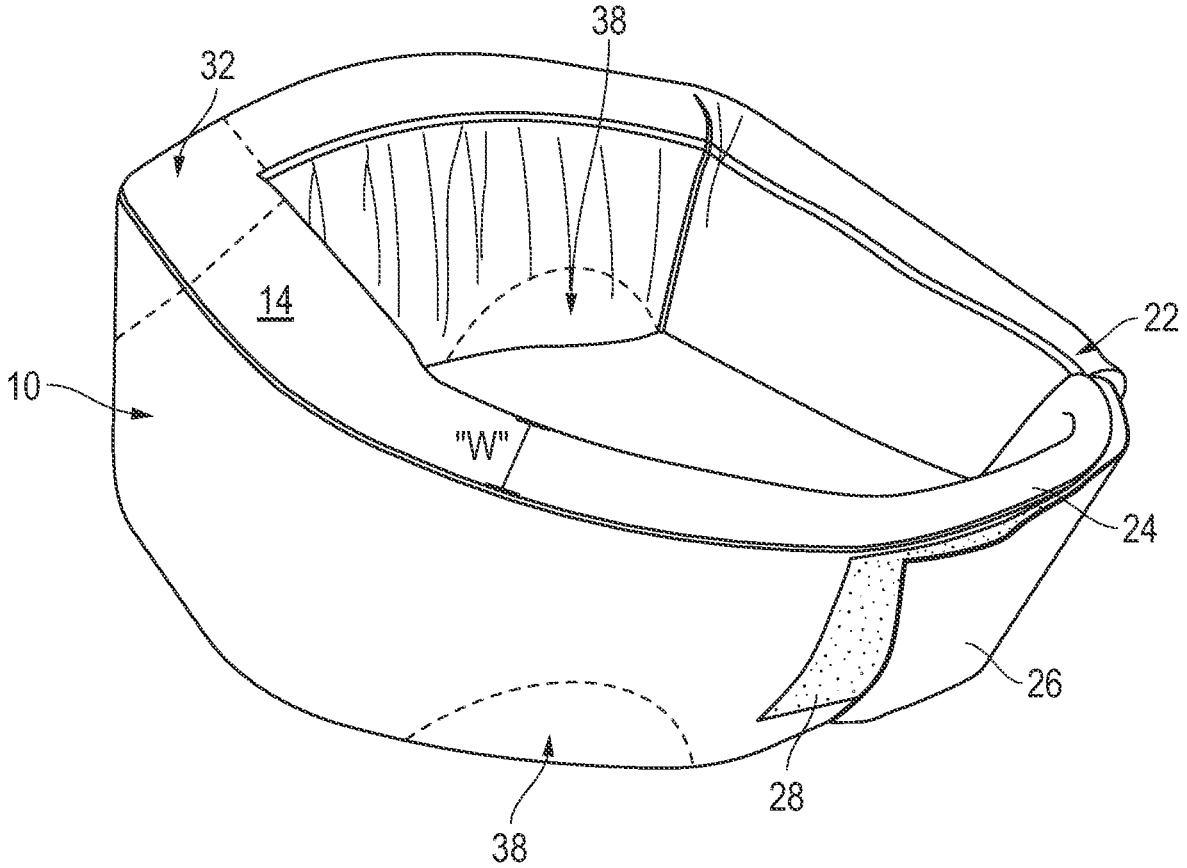
FIG. 3 is a perspective view of the invention of FIG. 1 with the first end and second end connected.

FIG. 3 shows the invention of FIG. 1 with the first end 22 connected with the second end 24. Certainly, any connector device, snaps, ties, etc., now known or hereafter developed is included within the scope of the invention, FIG. 4 illustrates the use of the head support apparatus 10 on a user and in place around a user's neck 36 while supporting the user's jaw 34 and resting on the user's shoulders 40 so as to prevent forward and lateral side to side motion of the head. The dotted lines in FIG. 4 show the user's jaw 34 in indentation 31 and the head supported on both sides by head support 10.

Figure 5:
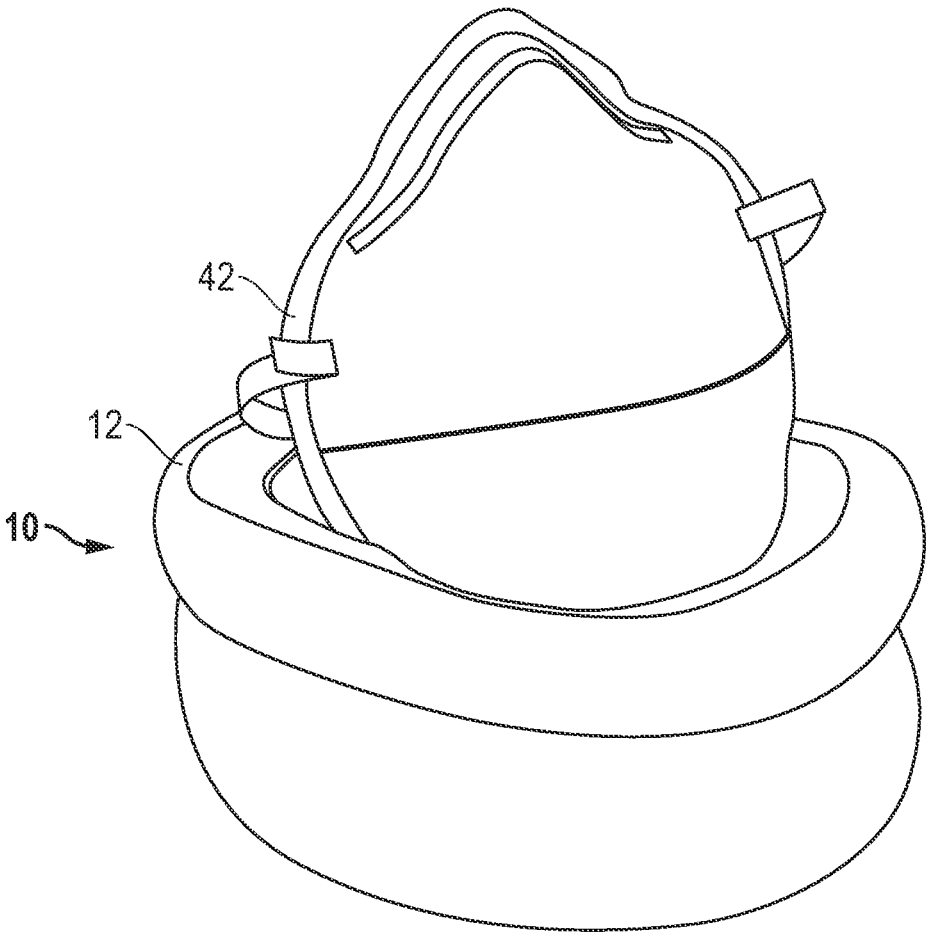
FIG. 5 is a perspective view of the invention of FIG. 1 with an optional personal protection mask connected therewith.

FIG. 5 illustrates the use of the head support apparatus 10 with optional personal protection mask 42. Personal protection mask 42 may be removably connected with wrap 12 by hook and loop material, buttons, snaps, or the like (not shown for clarity). Personal protection mask 42 may be a face mask as shown or an eye mask or any other protection device deemed useful according to the situational environment.

Figure 6:
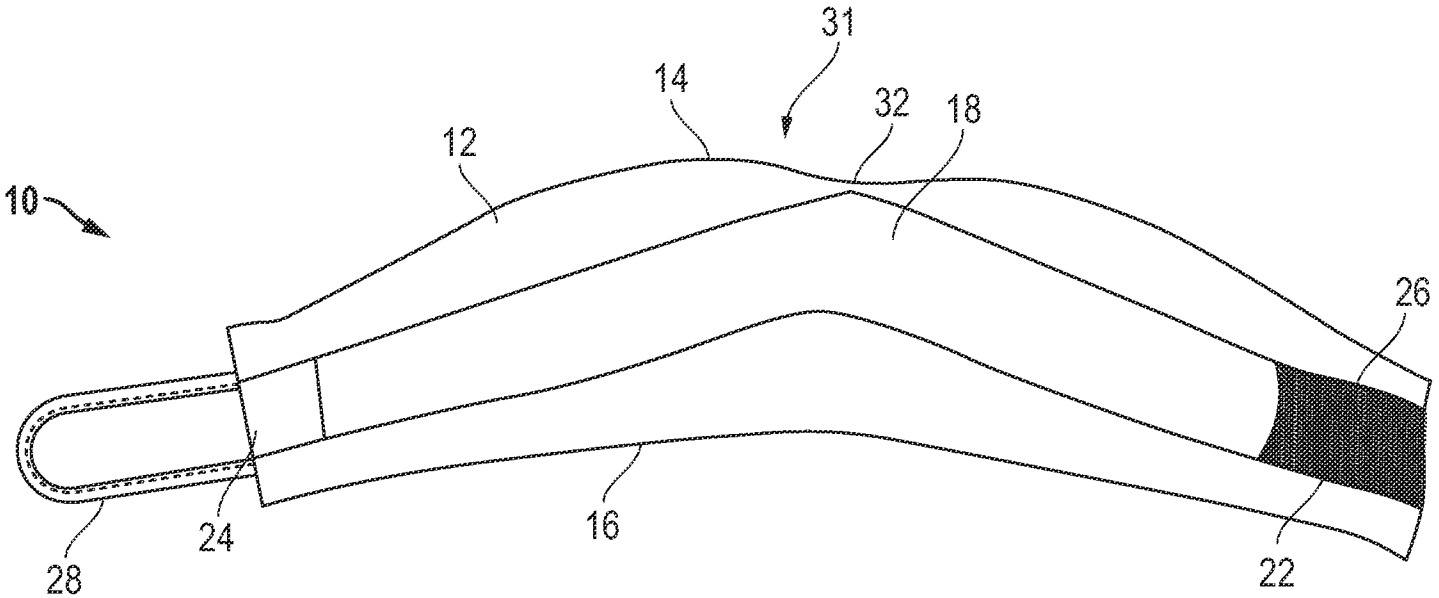
FIG. 6 is a top view of the invention of FIG. 1.

Finally, referring to FIG. 6, indentation 31 is shown as well as the tiered form of the head support 10 along its length. Applicant's have determined that this layering or tier construction enables the top of the head support 10 to surround the user's neck as the raised wave shape extends upward from the indentation 31 as shown. In other words, where a uniform dimension is shown in FIGS. 1 and 2, the raised wave shape is another preferred embodiment.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may within the spirit and scope of the invention as defined by the following claims.

What is claimed is:

1. A head support apparatus comprising:
   a. a wrap with a top, a bottom, a front, a back, a length, an inside and an outside and a first end and a second end;
   b. a connector on the first end and a connector on the second end wherein the connector on the first end is connectable with the connector on the second end;
   c. cushion material, with width, on the inside of the wrap where the cushion material width is greater along the length and front to back than at the first end and second end of of the wrap;
   d. an indentation in the front of the wrap and in the cushion material wherein the cushion material is configured to support a user's jaw and a user's head when said wrap is placed around a user's neck; and
   e. two cut outs, one on each side of the indentation in the cushion material and the wrap, wherein the cut outs are configured to receive and retain a user's shoulders and wherein the cut out on both sides of the indentation are inverted U-shapes.

2. The apparatus of claim 1 wherein the indentation is in the top of the front of the cushion material and wrap and the cut out on both sides of the indentation are in the bottom of the front of the cushion material and wrap.

3. The apparatus of claim 1 further including a personal protection mask removably connected to said wrap.

4. The apparatus of claim 1 wherein the wrap is washable.

5. The apparatus of claim 1 wherein the connector on the first end is hook material and the connector on the second end is loop material.

6. The apparatus of claim 1 wherein the indentation is in the top of the front of the cushion material and wrap and the cut outs are in the bottom of the wrap and cushion material.

7. A head support apparatus comprising:
   a. a wrap with a top, a bottom, a front, a back, a length, an inside and an outside and a first end and a second end;
   b. a connector on the first end and a connector on the second end wherein the connector on the first end is connectable with the connector on the second end;
   c. cushion material, with a width, on the inside of the wrap where the cushion material width is greater along the length and front to back than at the first end and second end of the wrap;
   d. a V-shaped indentation in the front of the wrap and in the cushion material wherein the cushion material is configured to support a user's jaw and a user's head when said wrap is placed around a user's neck; and
   e. two inverted U-shaped cut outs, one on each side of the V-shaped indentation in the cushion material and the wrap, wherein the inverted U-shaped cutouts are configured to receive and retain a user's shoulders.

8. The apparatus of claim 7 wherein the V-shaped indentation is in the top of the front of the wrap and the cushion material and the inverted U-shaped cutouts, one on each side of the V-shaped indentation am in the bottom of the wrap and the cushion material.

9. The apparatus of claim 7 wherein the V-shaped indentation is in the top of the front of the cushion material and wrap and the inverted U-shaped cutouts, one on each side of the V-shaped indentation are in the bottom of the front of the cushion material and wrap.

10. The apparatus of claim 7 further including a personal protection mask removably connected to said wrap.

11. The apparatus of claim 7 wherein the wrap is washable and wherein the connector on one end is hook material and the connector on the other end is loop material.

12. A head support apparatus comprising:
   a. a wrap with a top, a bottom, a front, a back, a length, an inside and an outside and a first end and a second end;
   b. a connector on the first end and a connector on the second end wherein the connector on the first end is connectable with the connector on the second end;
   c. cushion material, with a width, on the inside of the wrap where the cushion material width is greater along the length and front to back than at the first end and second end of the wrap;
   d. an indentation in the front of the wrap and in the cushion material wherein the cushion material is configured to support a user's jaw and a user's head when said wrap is placed around a user's neck, and
   e. a personal protection mask removably connected to said wrap.

13. The apparatus of claim 12 wherein the indentation is V-shaped.

14. The apparatus of claim 12 further including two cut outs, one on each side of the indentation in the cushion material and the wrap, wherein the cut outs are configured to receive and retain a user's shoulders.

15. The apparatus of claim 14 wherein the indentation is in the top of the front of the cushion material and wrap and the cut outs are in the bottom of the wrap and cushion material.

16. The apparatus of claim 14 wherein the indentation is in the top of the front of the cushion material and wrap and the cut outs are in the bottom of the front of the cushion material and wrap.

17. The apparatus of claim 12 wherein the wrap is washable.

18. The apparatus of claim 12 wherein the connector on the first end is hook material and the connector on the second end is loop material.

* * * * *